US009932054B2

(12) United States Patent
Weaver et al.

(10) Patent No.: US 9,932,054 B2
(45) Date of Patent: Apr. 3, 2018

(54) DOUBLE POINT DERAIL SWITCH

(71) Applicant: Progress Rail Services Corporation, Albertville, AL (US)

(72) Inventors: Brian Weaver, Burlington, KY (US); Phillip Merrifield, Independence, KY (US); Russell Hein, Denison, TX (US)

(73) Assignee: Progress Rail Services Corporation, Albertville, AL (US)

( * ) Notice: Subject to any disclaimer, the term of this patent is extended or adjusted under 35 U.S.C. 154(b) by 106 days.

(21) Appl. No.: 15/047,858

(22) Filed: Feb. 19, 2016

(65) Prior Publication Data

US 2017/0240190 A1 Aug. 24, 2017

(51) Int. Cl.
*B61K 5/00* (2006.01)
*B61K 5/06* (2006.01)

(52) U.S. Cl.
CPC ..... *B61K 5/06* (2013.01)

(58) Field of Classification Search
CPC ..... B61K 5/00; B61K 5/04; B61K 5/06
USPC ..... 246/429, 449, 454, 468, 163
See application file for complete search history.

(56) References Cited

U.S. PATENT DOCUMENTS 463,727 A * 11/1891 Grubbs ..... E01B 23/06 246/429
2,589,077 A * 3/1952 Haskell ..... B61K 5/06 104/268
3,944,174 A * 3/1976 Flinn ..... B61K 5/06 104/257
4,306,504 A * 12/1981 Charles ..... B61K 5/06 104/264
7,168,663 B2 * 1/2007 Schnedl ..... B61L 5/04 246/449
7,341,226 B2 * 3/2008 Biagiotti ..... B61L 5/065 246/435 R
8,313,041 B2 * 11/2012 Remington ..... E01B 9/60 238/333
2005/0116119 A1 * 6/2005 Biagiotti ..... B61L 5/10 246/449
2005/0178929 A1 * 8/2005 Biagiotti ..... B61L 5/00 246/449
2010/0006664 A1 * 1/2010 Hein ..... E01B 11/42 238/149
2012/0097802 A1 * 4/2012 Pease ..... B61K 5/06 246/163

FOREIGN PATENT DOCUMENTS

DE 3938947 A1 5/1991

* cited by examiner

*Primary Examiner* — Jason C Smith
(74) *Attorney, Agent, or Firm* — Miller, Matthias & Hull LLP

(57) ABSTRACT

A derailer for use in a railroad system, has an outside switch point that selectively overlays a running surface of a first mainline track and rises above the running surface of the first mainline track and an outside switch rail mechanically fastened to the outside switch point. The derailer also includes an inside switch rail including a second switch point that selectively lies adjacent a head of a second mainline track and terminates between the first and second mainline tracks.

19 Claims, 7 Drawing Sheets

DOUBLE POINT DERAIL SWITCH

TECHNICAL FIELD

The present disclosure generally relates to railroad track equipment and more particularly, relates to a derailer of such railroad equipment.

BACKGROUND

In the normal operation of railroad, it is often necessary to move a car, locomotive, or entire train from one track to another. If the train is to continue on, this is typically performed using a turnout that enables the train to be moved from one line to the other. however, sometimes in emergency situations it is necessary to derail the train or car off the track to prevent fouling of the mainline or other protected track, in order to prevent significant damage. Examples of such situations include when a train or unattended car is approaching a raised drawbridge, intersections with other rail lines or roadways, or when train crews are working, dead ends, and the like.

With such locations, a double point derail switch is purposely provided to for its ability to derail a train or unattended car. As the name implies, the switch derails the train to prevent entry to foul a main or protected track . A standard double point derail switch uses a normally closed switch for train traffic to continue unaltered on a mainline track. When derailing is required, the switch is opened the same as it would be if it was required to divert a train to another track and the train or car is routed onto a short truncated section and thus derailed so as to protect fouling a mainline or other protected track. However, because one switch point, when closed, sits above the main track, a train passing the double point derail switch experiences a bump and some crosslevel condition when traversing the switch. Further, because the switch is in the path of mainline train traffic during normal use, the switch requires routine maintenance even though it may never be activated for use as a derailer.

U.S. Pat. No. 463,727 (the '727 patent) issued Nov. 24, 1891 describes a switch which lifts a train car wheel over the active track. However, the way the switch rail in the '727 patent is constructed is impractical to produce and too costly to deploy.

SUMMARY OF THE DISCLOSURE

In accordance with one aspect of the disclosure, a derailer for use with railroad tracks includes an outside switch rail, an outside switch point mechanically fastened to the outside switch rail. The outside switch point selectively overlays a running surface of a first mainline rail and rises above the running surface of the first mainline rail. The derailer also includes an inside switch rail including a second switch point that selectively lies adjacent a head of a second mainline track and terminates between the first and second mainline rails.

In another aspect of the disclosure, a derailer includes an outside switch rail moveably mounted adjacent to a field side of a first mainline rail, the outside switch rail having a point end and a distal end and an outside switch point fixedly attached to the point end of the outside switch rail. The outside switch point includes a shelf having a flat bottom surface configured to rest on a running surface of the first mainline rail, a tapered upper surface that rises above the running surface of the first mainline rail, and a mounting bracket extending down from a side of the shelf. The mounting bracket is affixed to the outside switch rail. The derailer further includes an inside switch rail moveably mounted adjacent to a gage side of a second main rail. The derailer is configured, when activated, to lift via the shelf, a flange of a railcar wheel above and over the running surface of the first mainline rail.

In yet another aspect of the disclosure, a method of operating a derailer includes fastening an outside switch point to an outside switch rail, the outside switch rail mounted adjacent to a field side of a first mainline rail, the outside switch rail having a point end and a distal end. The outside switch point is fastened at the point end. The outside switch rail has a height above the running surface greater than a flange height of a railroad wheel. The method also includes moving the outside switch point over a running surface of the first mainline rail and coincident with moving the outside switch point over the running surface of the first mainline rail, setting a point of an inside switch rail against a gage side of a second mainline rail. The inside switch rail maintains an operating gage with the outside switch rail. The inside switch rail terminates between the first and second mainline rails approximately coequal with the distal end of the outside switch rail.

These and other aspects and features will be more readily understood when reading the following detailed description and taken in conjunction with the accompanying drawings.

DETAILED DESCRIPTION

Figure 1:
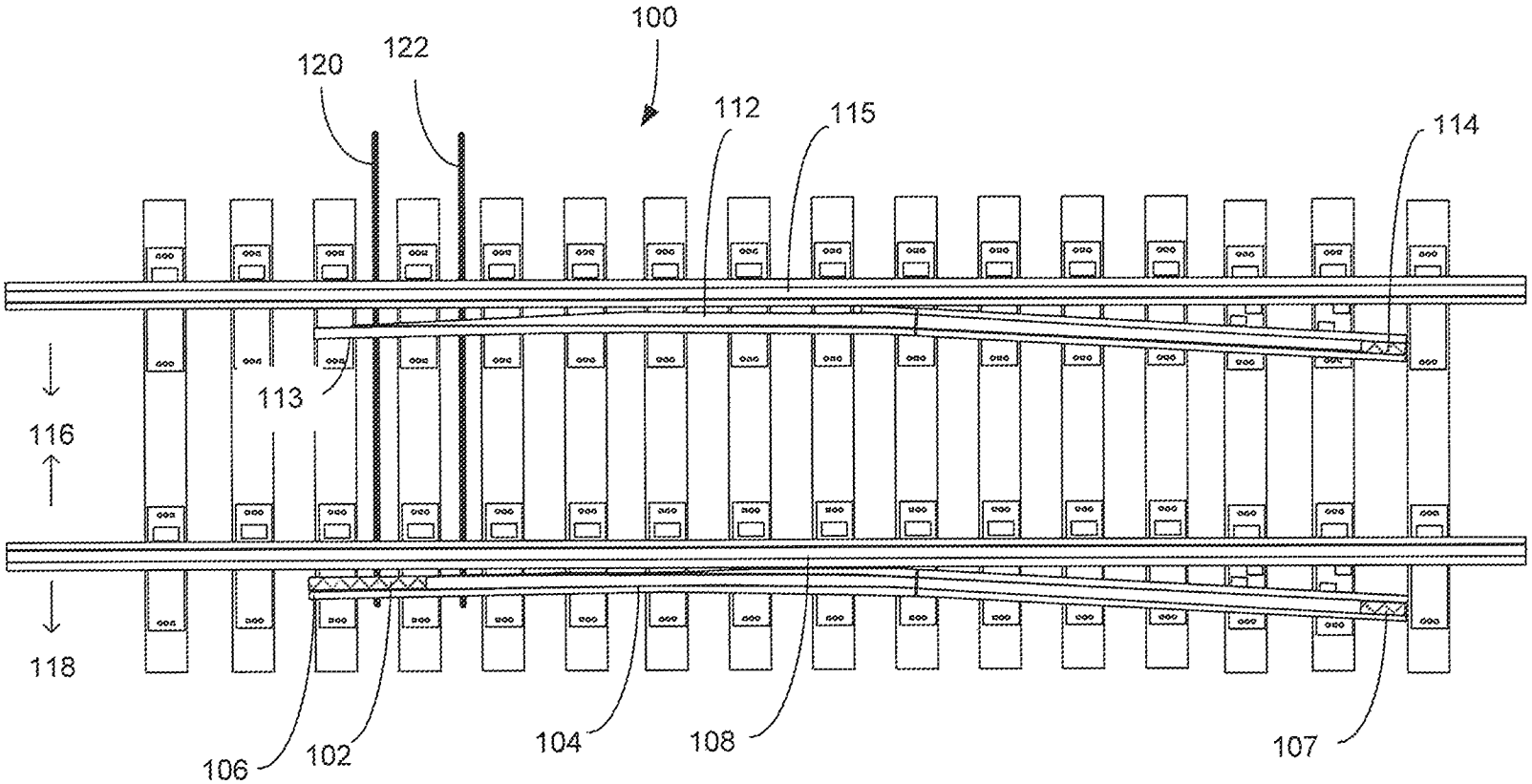
FIG. 1 is a top view of a derailer in accordance with the teachings of the present disclosure and depicted in an open, inactive state.
Figure 2:
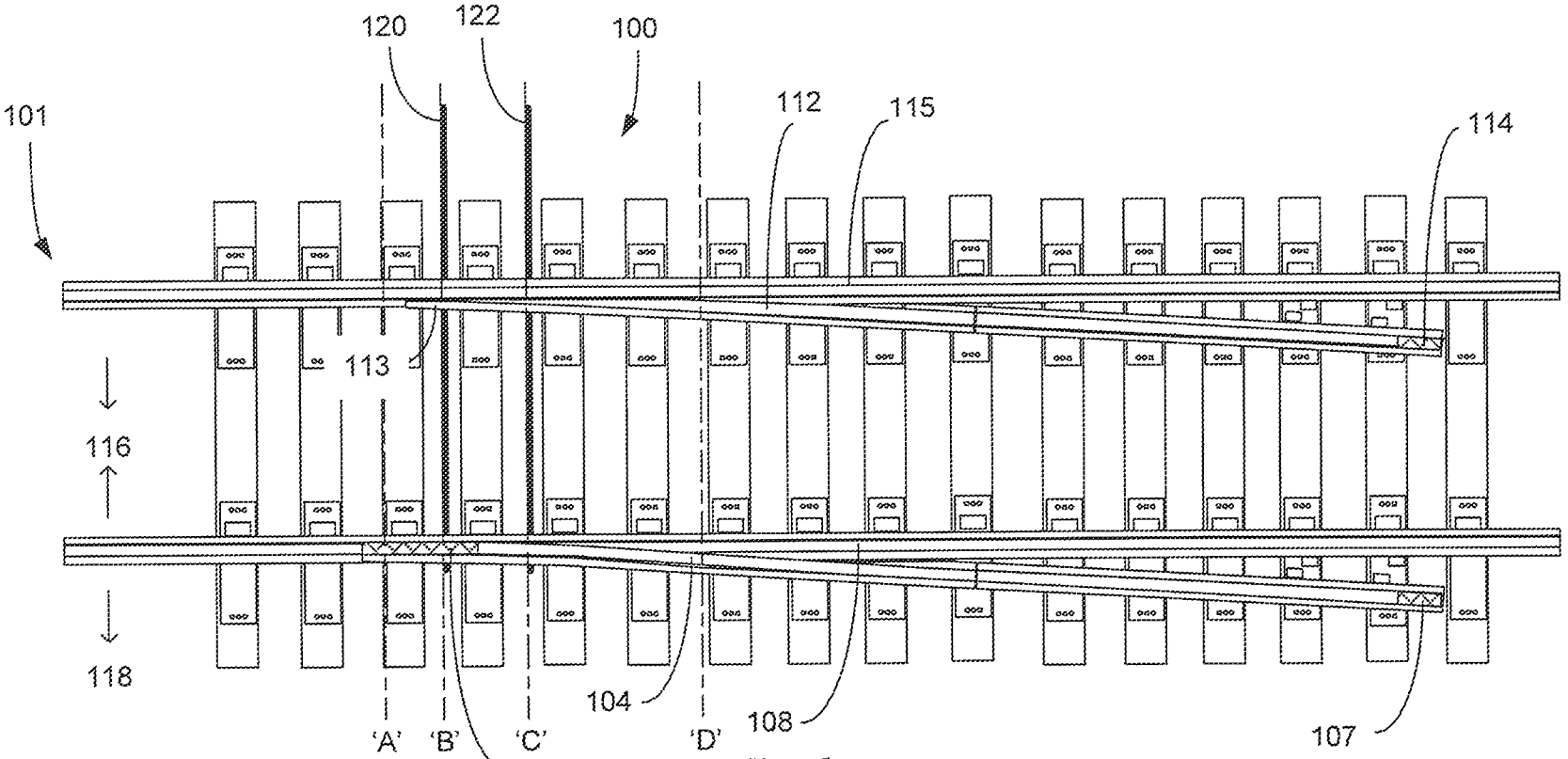
FIG. 2 is a top view of the derailer in a closed, active state.

Referring now to the drawings, and with specific reference to FIGS. 1 and 2, a derailer constructed in accordance with the present disclosure is generally referred to be reference number 100. The drawings exclude, for the sake of clarity, numerous details well known in the rail industry, including, but not limited to, spikes, clips, headblocks, and ballast. While the derailer 100 depicted in FIG. 1 is shown in the context of a mainline rail system, it is also applicable to other protected tracks or locations where it may be desirable to prevent an errant car or cars from entering another rail line or to protect a bridge structure or other assets.

The derailer 100 may be used to move a railroad car (not depicted) off a railroad track 101. However, in a significant departure from the prior art the derailer 100 of the present disclosure is deployed in a normally open position, thereby avoiding the raised configuration and bumps associated with normally closed prior art derailers. More specifically, an outside switch rail 104 includes an outside switch point 102. A point end 106 of the outside switch rail 104 includes a web portion without a head (shown in more detail in FIG. 7) and a distal end 107 with a downward curving arc (shown in more detail in FIG. 9). A first mainline rail 108 runs adjacent to the outside switch rail 104.

An inside switch rail 112 is mounted adjacent to a second mainline rail 115. The inside switch rail 112 includes a point end 113 and a distal end 114 opposite the point end 113. The distal end 114 may also include a downward curving arc similar to that of the outside switch rail distal end 107. In other embodiments, the distal end may simply end or may have a cut or ground slope. For the purpose of the following discussion, a gage side 116 of either mainline rail 108 or 115 is the side facing the other mainline rail. A field side 118 of the first mainline rail 108 is the side of the first mainline rail 108 facing away from the second mainline rail 115. The outside switch rail 104 is so designated because it is outside the gage limits of the track structure. Either or both of the switch rails 104, 112 may be a continuous rail or may have a joint at a heel block (not depicted). When derailing is desired, a head rod 120 and a back rod 122 are used pull the derailer 100 from the open position shown in FIG. 1 to the closed position shown in FIG. 2.

Turning to FIG. 2, after activation by movement of the head rod 120 and the back rod 122, the outside switch point 102 of the outside switch rail 104 overlays the first mainline rail 108 and the point end 113 of the inside switch rail 112 is pulled up against the gage-side of the second mainline rail 115. An end view of the derailer 100 from four positions, 'A,''B,''C,' and 'D' (shown in detail in FIG. 2) are shown in FIGS. 3-6, respectively, and will be described in further detail below.

Figure 3:
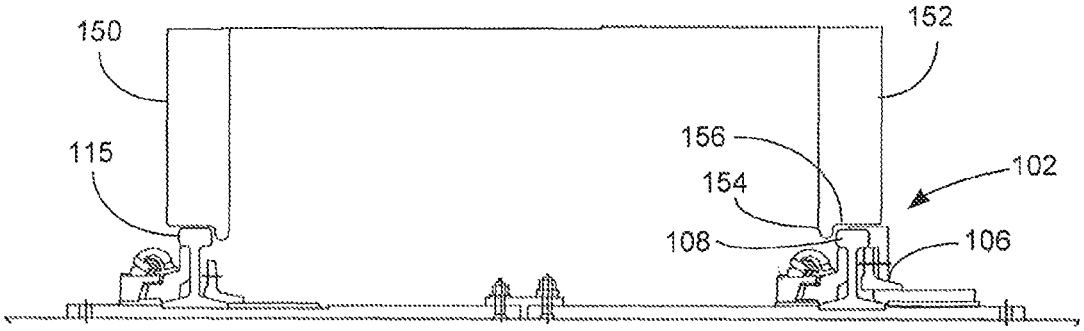
FIG. 3 is a cutaway view of the derailer at a first location.

As illustrated in FIG. 3, a view corresponding to the "A" reference line in FIG. 2 shows a railroad wheel 150 riding on the second mainline rail 115. Another railroad wheel 152 makes initial contact with the outside switch point 102 and begins to lift up off the first mainline rail 108. As shown in more detail below, the point end 106 of the outside switch rail 104 may be coupled to the outside switch point 102. The railroad wheel 152, as common to all railroad wheels, has a flange 154 and a wheel tread 156 which will be referenced below.

Figure 4:
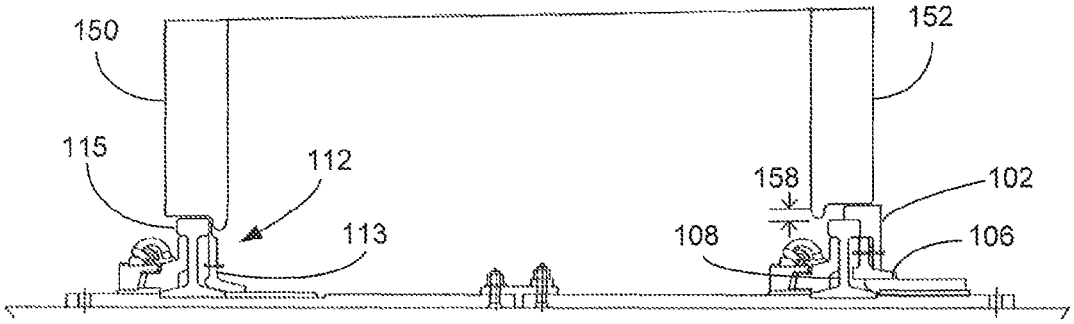
FIG. 4 is a cutaway view of the derailer at a second location.

Continuing to FIG. 4, a view corresponding to the "B" reference line in FIG. 2 is illustrated. The railroad wheel 150 makes initial contact with the point end 113 of the inside switch rail 112. On the opposite rail, the railroad wheel 152 is at this point fully supported by the outside switch point 102. As can be seen by comparison of FIG. 3 and FIG. 4, the outside switch point 102 is thinner at reference 'A' and tapers up to greater thickness at reference 'B', effectively lifting the wheel 152 above the running surface 131 (see FIG. 7) of the first mainline rail 108. Also illustrated, for discussion below, is a dimension corresponding to a height 158 of the flange 154 above the wheel tread 156. In the embodiment, the gage between the tracks varies within the ramping of the wheel and the diverging move to minimize the size of the insert material required.

Figure 5:
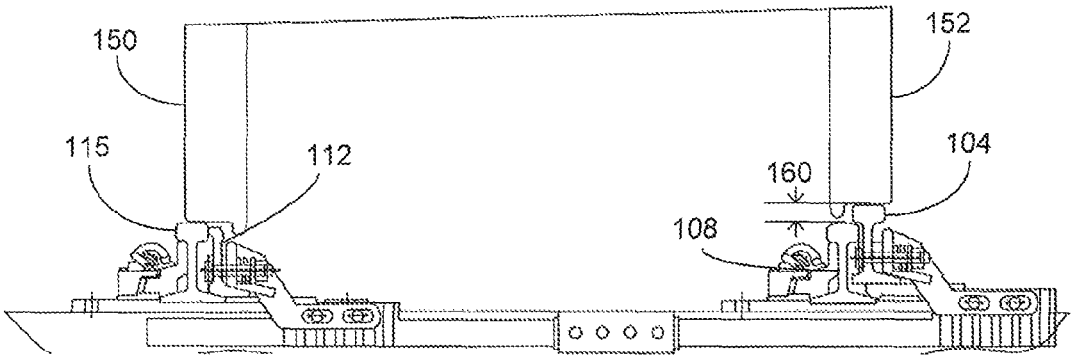
FIG. 5 is a cutaway view of the derailer at a third location.

A view of the derailer 100 corresponding to the "C" reference line of FIG. 2 is shown in FIG. 5. The railroad wheel 150 is now partially supported by the inside switch rail 112 while the railroad wheel 152 is now fully supported on the outside switch rail 104. Further, the running surface 131 of the outside switch rail 104 is above the running surface of the mainline by a height 160 that is greater than a height 158 of the flange 154. Because of this height difference, as the outside switch rail 104 and inside switch rail 112 begin to diverge from their respective mainline rails 108 and 115, the wheel 152 is lifted up and over the first mainline rail 108.

Figure 6:
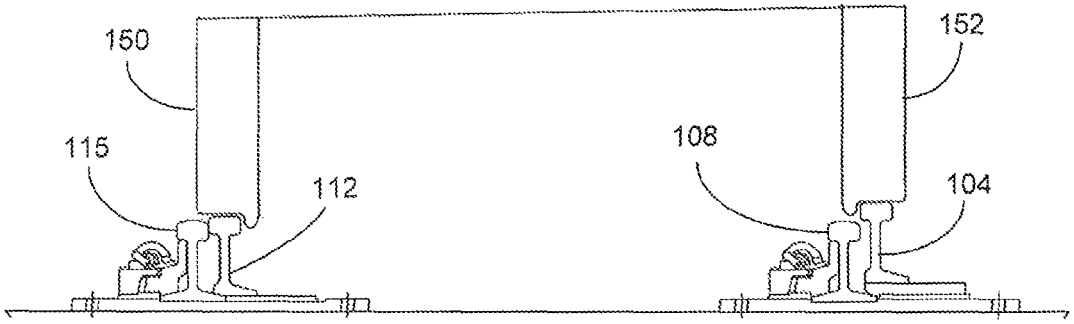
FIG. 6 is a cutaway view of the derailer at a fourth location.

FIG. 6 illustrates that, at reference "D" of FIG. 2, the wheel 150 is now fully supported on the inside switch rail 112 and the wheel 152 is now fully supported on the outside switch rail 104. The "D" position is also known as the head separation point, that is, the point where the switch rails and mainline rails diverge. The inside switch rail 112 is also raised above a running surface of its corresponding mainline rail 115 to generally maintain the wheels 150 and 152 at approximately the same height.

Figure 7:
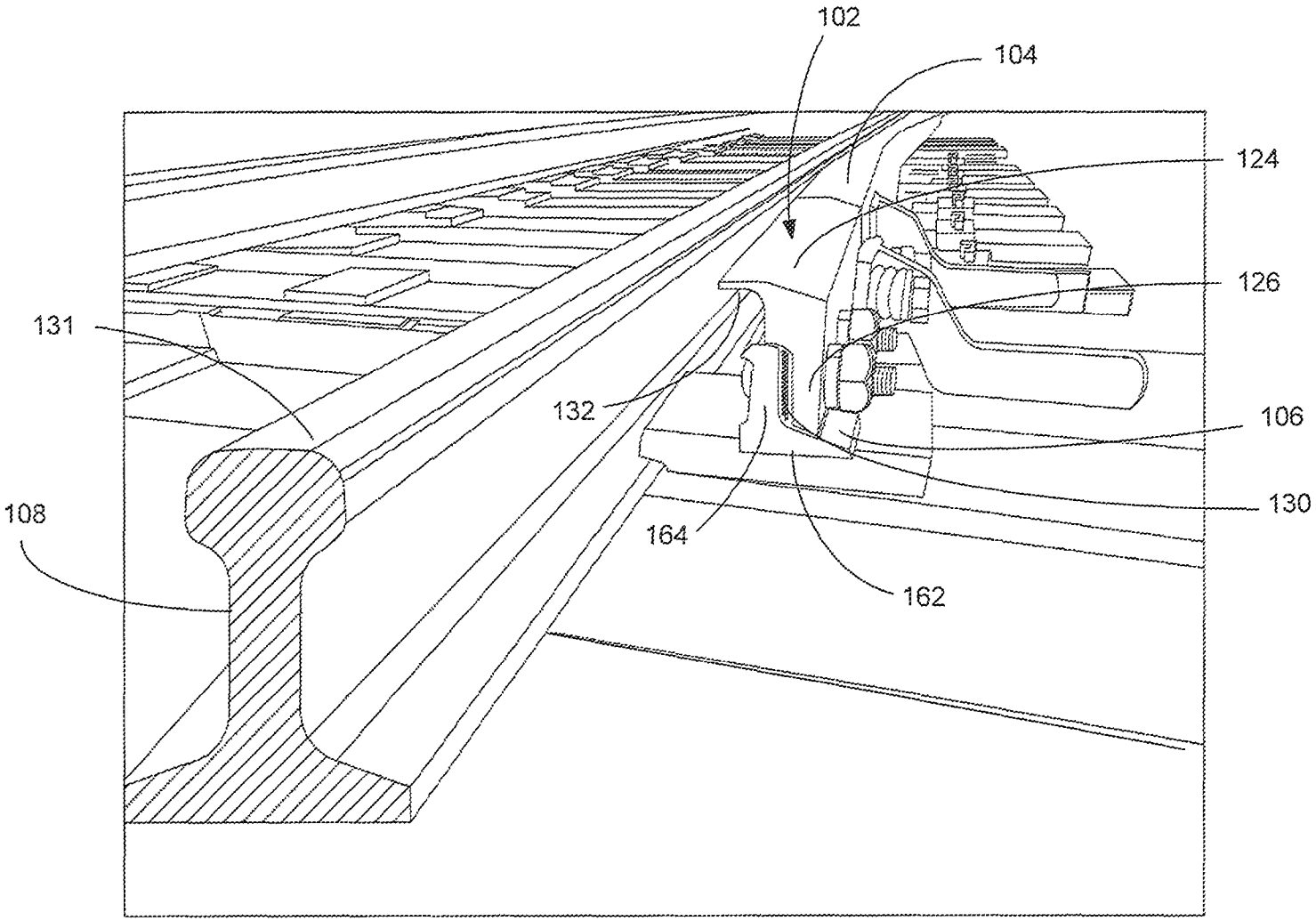
FIG. 7 is a perspective view of an outside switch rail of the derailer.

A perspective view of the first mainline rail 108 and the outside switch rail 104 is shown in FIG. 7. The first mainline rail 108 is shown with a running surface 131. The point end 106 of the outside switch rail 104 is headless, having a base 162 and web 164 only. A trailing portion of the outside switch rail beyond the outside switch point 102 has the full head, web, and base of a standard rail. The outside switch point 102 has a shelf 124 with a surface 132 that rests on a running surface 131 of the first mainline rail 108 when in position. The outside switch point 102 also has a mounting bracket 126 that extends down from the shelf 124 and is fixedly attached to the point end 106. The outside switch point 102 may be made from an alloy metal, different from the composition of the first mainline rail 108, to accommodate the relatively thin leading edge. In the illustrated embodiment, the outside switch point 102 is bolted to the point end 106. In some embodiments, a spacer 130 may be disposed to fill any space between the point end 106 and the outside switch point 102.

Figure 8:
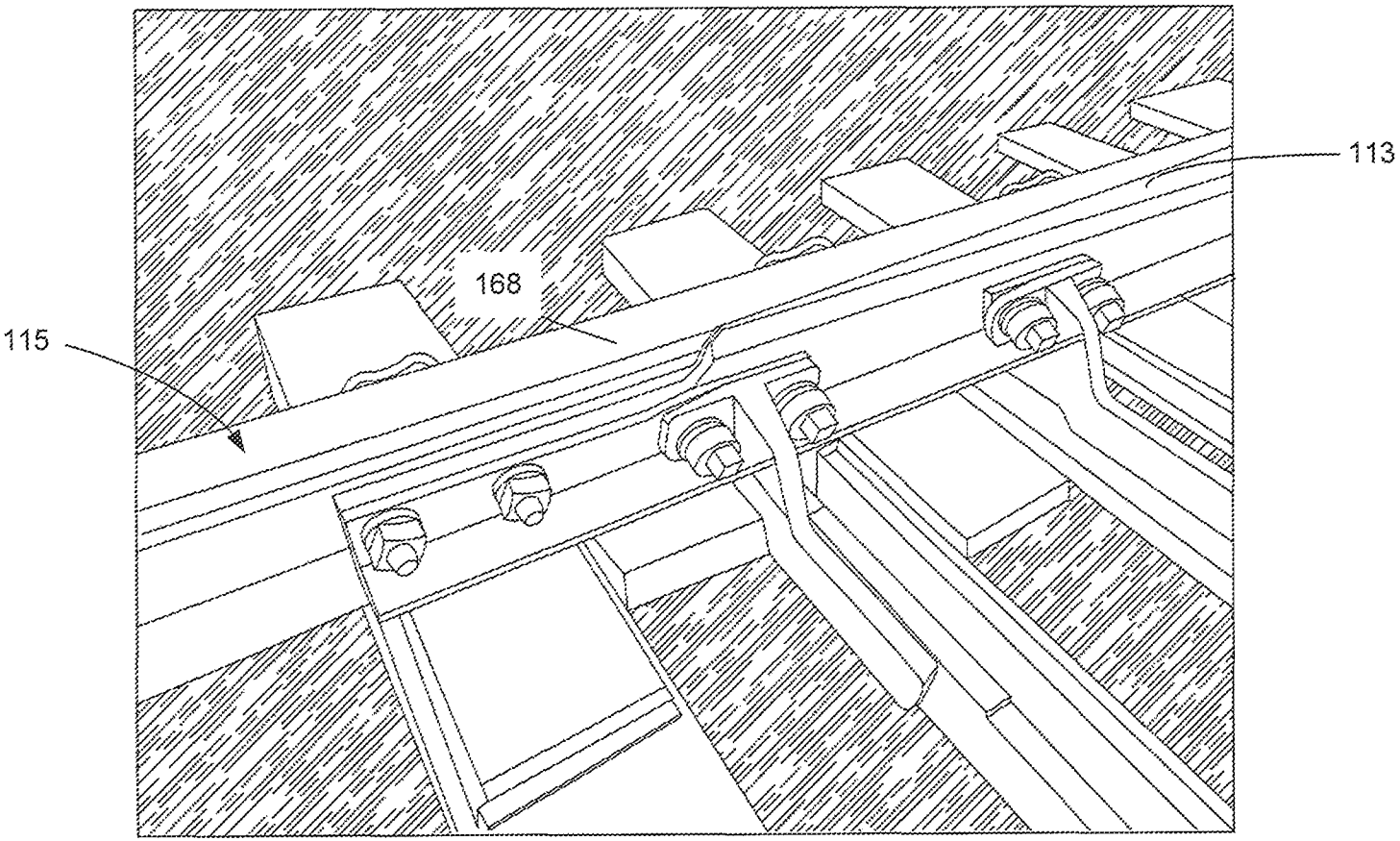
FIG. 8 is a perspective view of an inside switch rail of the derailer.

FIG. 8 is a perspective view of the second mainline rail 115 with the inside switch rail 112 in the operating position. The point end 113 of the inside switch rail is tapered along a vertical plane to seat against the gage side 116 of the head 168 of the second mainline rail 115. When closed, or activated, as shown in FIG. 8, the point end 113 engages a flange of the railroad wheel 150 and urges the railroad wheel 150 onto the inside switch rail 112, and at the same time, urges the opposite wheel 152 onto the outside switch rail 104.

Figure 9:
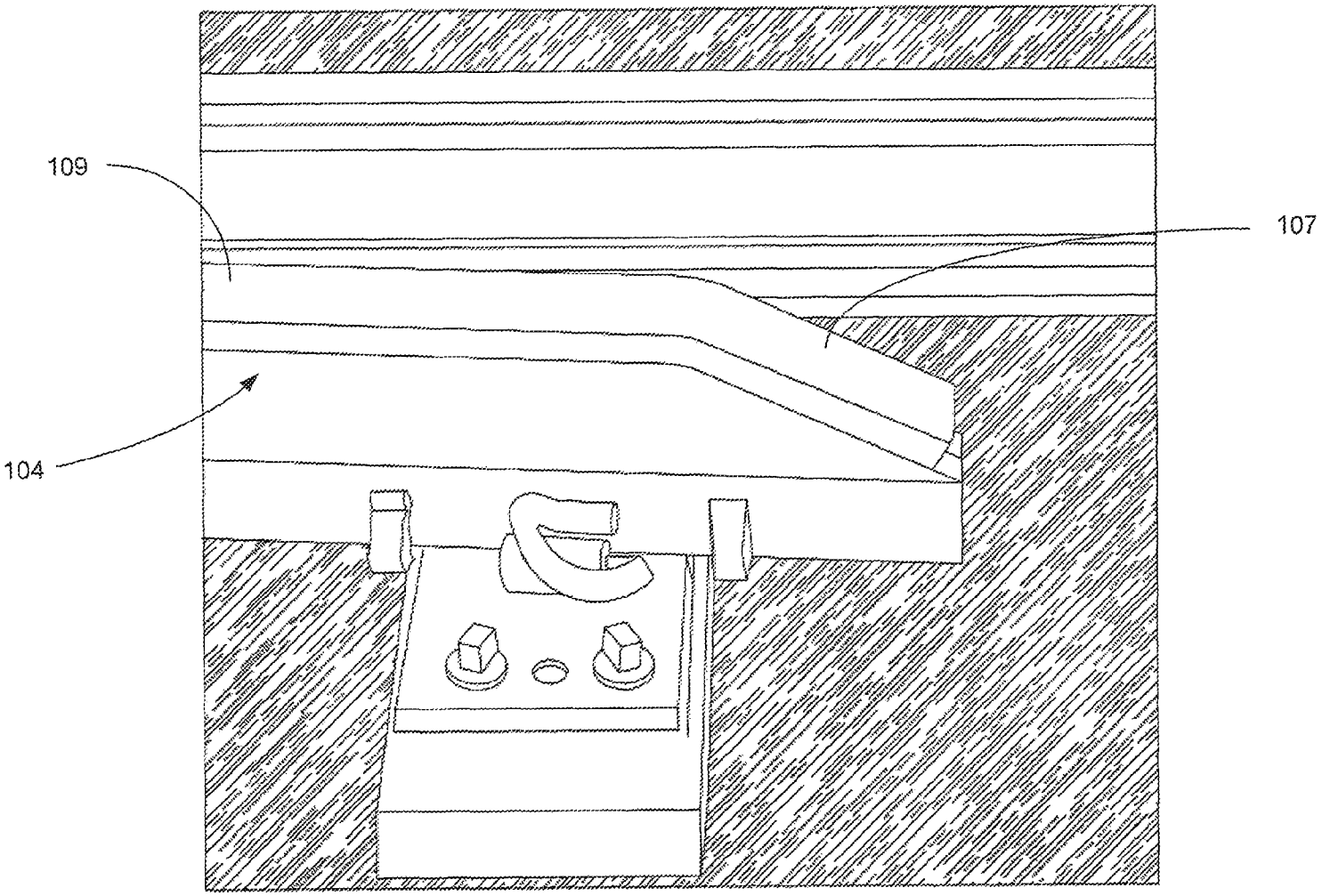
FIG. 9 is a perspective view of an end of the outside switch rail.

FIG. 9 illustrates the outside switch rail 104 at a distal end 107 of the outside switch rail 104. A running surface 109 of the distal end 107 of the inside switch track 104 has a downward arcing slope that dumps the railroad wheel 152 onto the ground, causing the desired derailing. The inside switch rail 112 has a similar distal end 114 that also dumps the wheel 150 onto the ground. In one embodiment, the distal ends 107 and 114 may be approximately coequal in placement. In another embodiment, the outside switch rail 104 may terminate before the inside switch rail in order to cause a rail car to tip toward the outside switch rail 104, that is, to the field side 118 of the first mainline rail 108.

INDUSTRIAL APPLICABILITY

In general, the present disclosure may find applicability in rail industries and may be used in mainline track or other track requiring protection from the undesired further movement of the train or unattended rail car.

Figure 10:
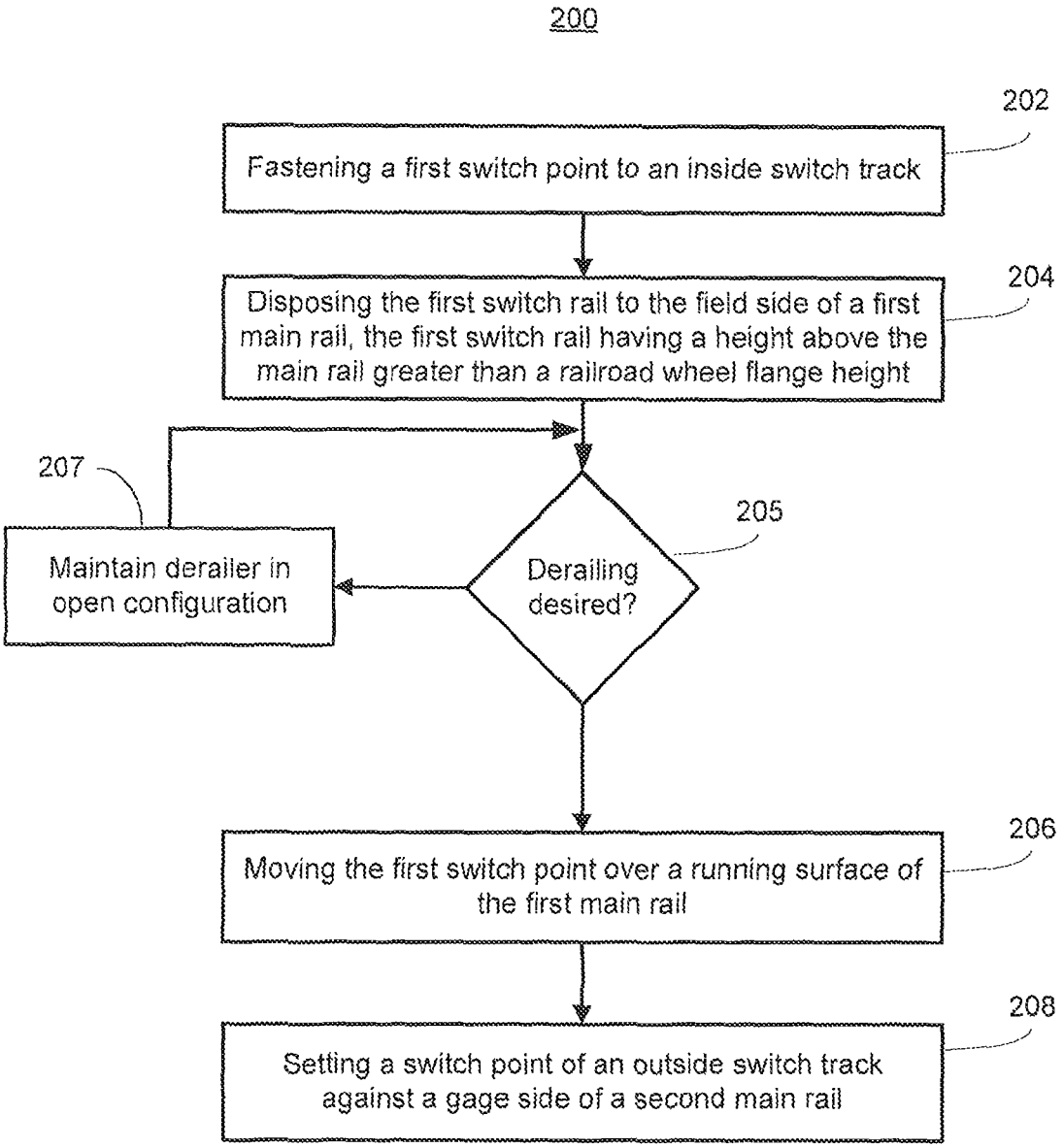
FIG. 10 is a flowchart of a method of operating a derailer in accordance with the teachings of the present disclosure.

A flowchart 200 for deploying a derailer 100 and derailing a train in accordance with the current disclosure are illustrated in FIG. 10. At block 202, an outside switch point 102 may be fastened to a point end 106 of an outside switch rail 104. The outside switch point 102 may include a shelf 124 with a surface 132 that is configured to rest on a running surface 131 of a first mainline rail 108 and a mounting bracket 126 that extends down from the shelf 124.

Continuing at block 204, the outside switch rail 104, including the outside switch point 102 may be disposed on a field side 118 of the first mainline rail 108. The outside switch rail 104 may be attached in a conventional manner to one or more rods 120, 122 that are used to move the outside switch rail 104 from an idle, or inactive position, to an operating, or active, position and back. The outside switch rail 104 has a height 160 above the first mainline rail 108 that is greater than a flange height 158 of a railroad wheel 152.

When derailing a train is desired as determined at decision block 205, the outside switch rail 104 is moved so that the outside switch point is positioned above the running surface 131 of the first mainline rail 108 as shown at block 206. As mentioned above, such purposed derailing may be desired when a train is approaching protected track, another line, construction, or the like, where further movement of the train along the line will cause damage of other assets. However, if derailing is not desired, nothing needs to be done as the derailer 100 is deployed in a normally open configuration as represented by a block 207.

The movement of an inside switch rail 112 and its associated point end 113 is represented at block 208. The inside switch rail 112, when activated by the head and back rods 120, 122, is moved into position on a gage side 116 of a second mainline rail 115. The point end 113 causes the wheel 150 to divert against the inside switch rail 112 in a conventional manner.

Both the inside switch rail 112 and the outside switch rail 104 are limited in length. When a car reaches the distal ends 107, 114 of the switch rails 104 and 112, the car will fall off the rails. In an embodiment, the inside switch rail 112 may be longer than the outside switch rail 104 so that the inside wheel 152 will spill onto the ground first and cause the car to tip toward the outside switch rail 104, away from the first mainline rail 108.

Among other things, the ability to provide a derailer that does not require a switch to be placed in the main line track provides several benefits. Among them, the elimination of a full-time activated derailer switch also eliminates the track bump associated with a closed switch and the related mechanical shock to cars as they pass over the old-style derailer. In addition, the old style derailer, because it is subjected to constant main line traffic, requires frequent maintenance to keep it in working order and maintain the required one fourth inch rise above the main line track. A derailer 100 in accordance with the current disclosure on the other hand has no contact with the main line rails during normal operation, eliminating the bump associated with the prior art derailer. Also because the derailer 100 of the current disclosure is not constantly subjected to train loads, the routine maintenance required to keep the derailer 100 in working order is also reduced. The use of an outside switch point 102 to attach to the point end 106 of the outside switch rail 104 reduces the complexity of the castings required and makes the implementation of the derailer 100 practical and cost effective compared to the prior art switch.

What is claimed is:

1. A derailer for use with railroad tracks, the derailer comprising:

an outside switch rail;

an outside switch point mechanically fastened to the outside switch rail, the outside switch point selectively overlays a running surface of a first mainline rail and rises above the running surface of the first mainline rail, wherein the outside switch point comprises a shelf and an extension extending down from a side of the shelf, the extension configured for mechanically fastening to the outside switch rail; and an inside switch rail including a second switch point that selectively lies adjacent a head of a second mainline track and terminates between the first and second mainline rails.

2. The derailer of claim 1, wherein the outside switch rail is welded to the outside switch point.

3. The derailer of claim 1, wherein the outside switch rail is bolted to the outside switch point.

4. The derailer of claim 1, wherein the derailer is deployed in a normally open position.

5. The derailer of claim 1, wherein the outside switch point is an alloy metal different from a metal of the first mainline rail.

6. The derailer of claim 1, wherein the outside switch rail has a headless point end that is mechanically fastened to the outside switch point and a trailing portion having a head, a base, and a web connecting the base to the head.

7. The derailer of claim 1, wherein an outside switch rail running surface is above the running surface of the first mainline rail by more than a flange height of a railroad wheel.

8. The derailer of claim 1, further comprising a head rod coupled to the outside switch rail and the inside switch rail and a back rod coupled to the outside switch rail and the inside switch rail, the head rod and the back rod configured to move the outside switch point and the second switch point into an active position with respect to the first and second mainline rails, respectively.

9. The derailer of claim 1, further comprising a spacer between the outside switch point and the outside switch rail.

10. A derailer comprising:

an outside switch rail moveably mounted adjacent to a field side of a first mainline rail, the outside switch rail having a point end and a distal end;

an outside switch point fixedly attached to the point end of the outside switch rail, the outside switch point including:

a shelf having a flat bottom surface configured to rest on a running surface of the first mainline rail and a tapered upper surface that rises above the running surface of the first mainline rail;

a mounting bracket extending down from a side of the shelf, the mounting bracket affixed to the outside switch rail; and an inside switch rail moveably mounted adjacent to a gage side of a second main rail, the derailer configured, when activated, to lift via the shelf, a flange of a railcar wheel above and over the running surface of the first mainline rail.

11. The derailer of claim 10, wherein a running surface of the outside switch rail aft of the shelf is higher than the running surface of the first mainline rail by at least a height of a railroad wheel flange.

12. The derailer of claim 10, wherein the running surface of the distal end of the outside switch rail has a head with a downward curving arc.

13. The derailer of claim 10, wherein the inside switch rail has a point that is tapered along a vertical plane to seat adjacent to the gage side of a head of the second main rail when the derailer is activated.

14. The derailer of claim 13, wherein a running surface of a distal end opposite the point of the inside switch rail has a head with a downward curving arc.

15. The derailer of claim 10, wherein the outside switch rail is free of the first mainline rail when the derailer is not activated.

16. The derailer of claim 10, wherein the inside switch rail is free of with the second main rail when the derailer is not activated.

17. The derailer of claim 10, wherein the point end of the outside switch rail has a web absent the head, the web adapted for affixing the mounting bracket to the outside switch rail.

18. A method of operating a derailer, the method comprising:

fastening an outside switch point to an outside switch rail, the outside switch rail mounted adjacent to a field side of a first mainline rail, the outside switch rail having a point end and a distal end, the outside switch point fastened at the point end, the outside switch rail having a height above the running surface greater than a flange height of a railroad wheel;

moving the outside switch point over a running surface of the first mainline rail; and coincident with moving the outside switch point over the running surface of the first mainline rail, setting a point of an inside switch rail against a gage side of a second mainline rail, the inside switch rail maintaining an operating gage with the outside switch rail, the inside switch rail terminating between the first and second mainline rails approximately coequal with the distal end of the outside switch rail.

19. The method of claim 18, further comprising:

forming the distal end of the outside switch rail with a downward curving arc.

* * * * *